US010214946B2

(12) United States Patent
Fukumoto

(10) Patent No.: US 10,214,946 B2
(45) Date of Patent: Feb. 26, 2019

(54) LOCKING DEVICE

(71) Applicant: NIFCO INC., Yokosuka-shi, Kanagawa (JP)

(72) Inventor: Mitsuru Fukumoto, Yokosuka (JP)

(73) Assignee: NIFCO INC., Yokosuka-Shi, Kanagawa (JP)

( * ) Notice: Subject to any disclaimer, the term of this patent is extended or adjusted under 35 U.S.C. 154(b) by 98 days.

(21) Appl. No.: 15/029,467

(22) PCT Filed: Oct. 9, 2014

(86) PCT No.: PCT/JP2014/077082
§ 371 (c)(1),
(2) Date: Apr. 14, 2016

(87) PCT Pub. No.: WO2015/056627
PCT Pub. Date: Apr. 23, 2015

(65) Prior Publication Data
US 2016/0258195 A1 Sep. 8, 2016

(30) Foreign Application Priority Data
Oct. 16, 2013 (JP) ..... 2013-215689

(51) Int. Cl.
*E05C 1/12* (2006.01)
*E05C 1/14* (2006.01)
(Continued)

(52) U.S. Cl.
CPC ..... *E05C 1/12* (2013.01); *E05B 17/0041* (2013.01); *E05B 17/0045* (2013.01);
(Continued)

(58) Field of Classification Search
CPC .... E05C 1/12; E05B 17/0041; E05B 17/0045; E05B 77/42; E05B 1/14; E05B 85/18;
(Continued)

(56) References Cited

U.S. PATENT DOCUMENTS 4,227,723 A * 10/1980 Rosell ..... E05C 9/002 292/34
4,476,700 A * 10/1984 King ..... E05C 9/041 292/39
(Continued)

FOREIGN PATENT DOCUMENTS

DE 102005003131 A1 10/2005
EP 1031682 A1 8/2000
(Continued)

OTHER PUBLICATIONS

PCT International Search Report of PCT/JP2014/077082.
Europe Patent Office, "Search Report for European Patent Application No. 14854550.2," dated Jul. 7, 2017.

*Primary Examiner* — Kristina R Fulton
*Assistant Examiner* — Faria F Ahmad
(74) *Attorney, Agent, or Firm* — Manabu Kanesaka

(57) ABSTRACT

A locking device includes a lever turnably provided relative to a lid member, and switched from an initial state to an operating state against an urging force or self-weight; a lock rod sliding in association with turning of the lever; and a braking device. The locking device locks the lid member in a main member side through the lock rod, and switches the lid member to be unlocked by turning of the lever. The braking device is a rotation damper including a braking shaft with a gear, and placed to approximately conform to a turning center of the lever relative to the lever to damp the lever and the lock rod. The rotation damper includes an operation gear disposed to engage the gear of the rotation damper, associate the gear with sliding of the lock rod, and rotate the gear in a direction opposite to the turning of the lever.

7 Claims, 10 Drawing Sheets

(51) Int. Cl.

| | |
|---|---|
| ***E05B 17/00*** | (2006.01) |
| ***E05B 17/04*** | (2006.01) |
| ***E05B 47/00*** | (2006.01) |
| ***E05B 77/42*** | (2014.01) |
| ***B65B 57/02*** | (2006.01) |
| ***E05C 1/06*** | (2006.01) |

(52) U.S. Cl.
CPC ..... *E05B 77/42* (2013.01); *E05C 1/14* (2013.01); *E05B 2017/043* (2013.01); *E05B 2047/002* (2013.01); *Y10T 292/0843* (2015.04); *Y10T 292/096* (2015.04); *Y10T 292/0966* (2015.04); *Y10T 292/1018* (2015.04)

(58) Field of Classification Search
CPC ..... E05B 17/042; E05B 2017/043; E05B 2047/002; E05B 2047/0021; E05B 81/34; E05B 81/36; E05B 81/38; E05B 83/28; E05B 83/30; E05B 83/32; E05B 83/34; Y10T 292/0834; Y10T 292/0836; Y10T 292/0837; Y10T 292/0844; Y10T 292/096; Y10T 292/0966; Y10T 292/1018; Y10T 292/0993; Y10T 292/0933; Y10T 292/0977; Y10T 292/0964; Y10T 292/0971; Y10T 292/0978; Y10T 292/1016; Y10T 292/1037; Y10T 292/307; Y10T 292/308
USPC ..... 292/34–34, 39, 40, 137, 160, 142
See application file for complete search history.

(56) References Cited

U.S. PATENT DOCUMENTS

| | | | | |
|---|---|---|---|---|
| 5,222,774 | A * | 6/1993 | Fukumoto | E05B 81/14 292/144 |
| 5,826,922 | A * | 10/1998 | Wernig | E05C 9/041 292/39 |
| 6,460,904 | B1 | 10/2002 | Stapf | |
| 7,036,852 | B2 * | 5/2006 | Cho | E05B 83/30 292/142 |
| 7,343,646 | B2 | 3/2008 | Hayashi | |
| 7,421,868 | B2 * | 9/2008 | Matyko | E05C 9/042 292/39 |
| 7,455,333 | B2 * | 11/2008 | Ookawara | E05B 83/30 292/34 |
| 7,832,239 | B2 * | 11/2010 | Kozuka | E05B 83/30 292/39 |
| 8,181,393 | B2 * | 5/2012 | Talpe | E05B 65/1006 292/142 |
| 8,690,204 | B2 * | 4/2014 | Lang | E05B 81/77 292/279 |
| 8,701,327 | B2 * | 4/2014 | Kincel | F41G 11/005 292/245 |
| 8,763,836 | B2 * | 7/2014 | Becklin | B65D 21/0223 220/210 |
| 2001/0037702 | A1 | 11/2001 | Wood | |
| 2002/0121786 | A1 * | 9/2002 | Meinke | E05B 85/107 292/347 |
| 2003/0193199 | A1 * | 10/2003 | Talukdar | E05B 83/30 292/172 |
| 2004/0239121 | A1 * | 12/2004 | Morris | E05B 13/004 292/39 |
| 2005/0127684 | A1 * | 6/2005 | Keightley | E05B 15/10 292/144 |
| 2005/0172685 | A1 * | 8/2005 | Keightly | E05B 47/0012 70/279.1 |
| 2005/0225095 | A1 * | 10/2005 | Geurden | E05B 15/1635 292/39 |
| 2006/0208495 | A1 * | 9/2006 | Talukdar | E05B 83/30 292/39 |
| 2007/0080543 | A1 * | 4/2007 | Johnson | E05B 63/20 292/39 |
| 2010/0005621 | A1 * | 1/2010 | Tomioka | E05F 3/102 16/82 |
| 2010/0031468 | A1 * | 2/2010 | Tomiji | E05F 5/027 16/52 |
| 2011/0309640 | A1 * | 12/2011 | Matsubara | E05B 63/248 292/159 |
| 2011/0309642 | A1 | 12/2011 | Shimizu | |
| 2012/0049544 | A1 * | 3/2012 | Kwon | E05B 85/107 292/336.3 |
| 2012/0242095 | A1 * | 9/2012 | Niwa | E05B 81/18 292/142 |
| 2014/0225379 | A1 | 8/2014 | Fukumoto | |
| 2015/0115618 | A1 * | 4/2015 | Ito | E05B 83/34 292/137 |
| 2015/0115619 | A1 * | 4/2015 | Ito | E05B 83/34 292/137 |
| 2015/0115620 | A1 * | 4/2015 | Ito | E05B 83/34 292/137 |
| 2015/0115621 | A1 * | 4/2015 | Kitamura | E05B 83/34 292/137 |

FOREIGN PATENT DOCUMENTS

| | | | |
|---|---|---|---|
| JP | H01-148467 | U | 10/1989 |
| JP | 2001-020583 | A | 1/2001 |
| JP | 2001-262919 | A | 9/2001 |
| JP | 2002-331875 | A | 11/2002 |
| WO | 00/50710 | A1 | 8/2000 |

* cited by examiner

LOCKING DEVICE

FIELD OF TECHNOLOGY

The present invention relates to a locking device engaging/disengaging a lid member with/from a main member side, and especially, in a case wherein a lever for a turning operation is switched from an initial state to an operating state against an urging force or self-weight, the locking device improves a feeling of a lever operation or suppresses generation of a hitting sound.

BACKGROUND ART

FIGS. 10(*a*) and 10(*b*) show a locking device disclosed in Patent Document 1, wherein FIG. 10(*a*) is a whole perspective view; and FIG. 10(*b*) is a side view of a handle, a fixation member, and a damper. In the drawings, the locking device comprises a handle (corresponding to the lever of the present invention) 20 turnably provided relative to the lid member opening and closing an opening portion on the main member side through a fixation member 30, and switched from the initial state to the operating state against the urging force; a connection member (not shown in the drawings, and corresponding to a lock rod of the present invention) forming a lock mechanism 50, and operating by the turning operation of the lever 20; and a damper which is a braking device. The lock mechanism locks the lid member on the main member side through the connection member, and switches the lid member to be unlocked by turning the handle 20. Specifically, when the handle 20 is pulled in an arrow direction, the turning operation of the handle 20 unlocks the lock mechanism through the connection member so as to open the lid member by the self-weight and the like.

At that time, when an operator releases one's hand from the handle 20, the handle returns to an original position by the urging force; however, if the handle strongly returns to the original position, the handle generates the hitting sound, so that the damper suppresses the hitting sound. Namely, the damper includes a first member 28 including a housing 34, a rotor 42, and a rotor turning shaft 49, and provided on a handle 20 side; and a second member 43 provided in the rotor 42, and connected to a fixation member 30 side. Also, on one of both members 28 and 43, there is provided a slit 25, and on the other of both members 28 and 43, there is provided a protruding portion 44 loosely fitted into the slit 25. The first member 28 and the second member 43 form a link mechanism, and when the second member 43 on a rotor side associates with the first member 28, the protruding portion 44 moves inside the slit 25.

PRIOR ART DOCUMENT

Patent Document

Patent Document 1: Japanese Unexamined Patent Application Publication No. 2012-2020

SUMMARY OF THE INVENTION

Problems to be Solved by the Invention

In the aforementioned locking device, is described that the link mechanism using the slit is provided so as to provide smooth operation feeling compared to a link mechanism using a gear (Japanese Utility Model Publication No. H01-148467). However, in this structure, the housing, the rotor, and the rotor turning shaft, which are essential portions of the damper, are connected to a fixation member side, and a movement of the lid member is damped through the link mechanism by the slit and the protruding portion, so that if a braking force is attempted to be affected in a wider range, whole lengths of the slit or both members have to be long so as to sacrifice a reduction of size. Also, in this structure, it is only limited for the braking force to damp the lid member, and it is not effective to damp or vary the movement of the connection member and the like forming the lock mechanism.

An object of the present invention is to solve the aforementioned problems, and easily damp a movement of the lock rod as well in addition to a suppression of the hitting sound of the returning lever by the braking force stable and effective within a wide range. Other objects of the present invention will be clarified in the following explanation of contents.

Means for Solving the Problems

In order to obtain the aforementioned objects, the present invention is a locking device comprising a lever turnably provided relative to a lid member opening and closing an opening portion on a main member side, and switched from an initial state (this is a state wherein the lever is not turned) to an operating state (this is a state wherein the lever is turned) against an urging force or self-weight; a lock rod sliding in association with turning of the lever; and a braking device. The lid member is locked in a main member side through the lock rod, and is switched to be unlocked by the turning of the lever. The braking device is a rotation damper including a braking shaft with a gear, and placed in such a way as to approximately conform to the turning center of the lever relative to the lever to damp the lever and the lock rod, and the braking device includes an operation gear disposed in a state engaging the gear of the rotation damper, associating the gear with sliding of the lock rod, and rotating in a direction opposite to the turning of the lever.

In the aforementioned present invention, it is more preferable to be embodied with the following preferred aspects.

(1) A structure includes a slide member sliding in association with the turning of the lever by a pressing portion provided in the lever; and an inclined face associating the lock rod to be slidable, and a rack turning the operation gear, respectively provided in the slide member. In the aspect, there are formed the inclined face associating the lock rod to be slidable, and the rack turning the operation gear, and there is included the slide member sliding in association with the turning of the lever by the pressing portion on a lever side, so that a force accompanied by the turning of the lever can be operated to the lock rod and the operation gear by a single member, i.e. only the slide member.

(2) The operation gear has a damper teeth portion engaging the gear of the rotation damper with a larger diameter compared to a rack teeth portion engaging the rack of the slide member. In the aspect, compared to the rack teeth portion engaging the rack of the slide member, the operation gear has a diameter larger than that of the damper teeth portion engaging the gear on a rotation damper side so as to increase a rotation number of the gear on the rotation damper side to obtain a large stable braking force.

(3) A structure includes one more lock rod slidably disposed with the aforementioned lock rod to associate with the operation gear, and switches between a locking position where both lock rods are separated from each other to keep the lid member in a closed state, and a release position where both lock rods are approached to each other. In the aspect, there is included one more lock rod slidably disposed with the lock rod to associate with the operation gear, so that it becomes preferable for a pair of lock type switching between the locking position where both lock rods are separated from each other to keep the lid member in the closed state, and the release position where both lock rods are approached to each other.

(4) The operation gear is a structure including a lock rod teeth portion engaging the rack provided in the one more lock rod. As for the aspect, in a fourth aspect, there is included the lock rod teeth portion wherein the operation gear engages the rack provided in the one more lock rod, so that the facing lock rod can be easily formed to be associated as well.

Effect of the Invention

The present invention has a structure of using the rotation damper including the braking shaft with the gear, and placing the rotation damper in such a way as to approximately conform to the rotation center of the lever relative to the lever, and a structure comprising the operation gear disposed in the state engaging the gear of the rotation damper, associating the gear with the sliding of the lock rod, and rotating the gear in the direction opposite to the turning of the lever, so that the operation gear is engaged with the gear on the rotation damper side. Accordingly, compared to the Patent Document 1, a braking range can be widely set, and a returning speed of the lever is damped, and at the same time, the sliding of the lock rod is damped so as to reduce and absorb a hitting sound accompanied by the returning lever or a sliding halt.

BRIEF DESCRIPTION OF THE DRAWINGS

FIG. 1(*b*) is a perspective view in a state of being displaced to an upper side with approximately 90 degrees from a state in FIG. 1(*a*).

FIG. 2(*b*) is a front view; and FIG. 2(*c*) is a bottom view.

FIG. 3(*b*) is a right side view.

FIG. 4(*b*) is a perspective view in an operating state of the lever.

FIG. 5(*b*) is a perspective view in the operating state of the lever.

FIG. 6(*b*) is a front view; and FIG. 6(*c*) is a cross-sectional view taken along a line A-A in FIG. 6(*b*).

FIG. 7(*b*) is a cross-sectional view taken along a line C-C in FIG. 6(*b*); and FIG. 7(*c*) is a cross-sectional view taken along a line D-D in FIG. 6(*b*).

FIG. 8(*b*) is a front view; and FIG. 8(*c*) is a cross-sectional view taken along a line A1-A1 in FIG. 8(*b*).

FIG. 9(*b*) is a cross-sectional view taken along a line C1-C1 in FIG. 8(*b*); and FIG. 9(*c*) is a cross-sectional view taken along a line D1-D1 in FIG. 8(*b*).

BEST MODES OF CARRYING OUT THE INVENTION

Hereinafter, embodiments of the present invention will be explained with reference to the attached drawings. In the explanation, after a structural example of a locking device is clarified, main operations will be described.

Figure 1A:
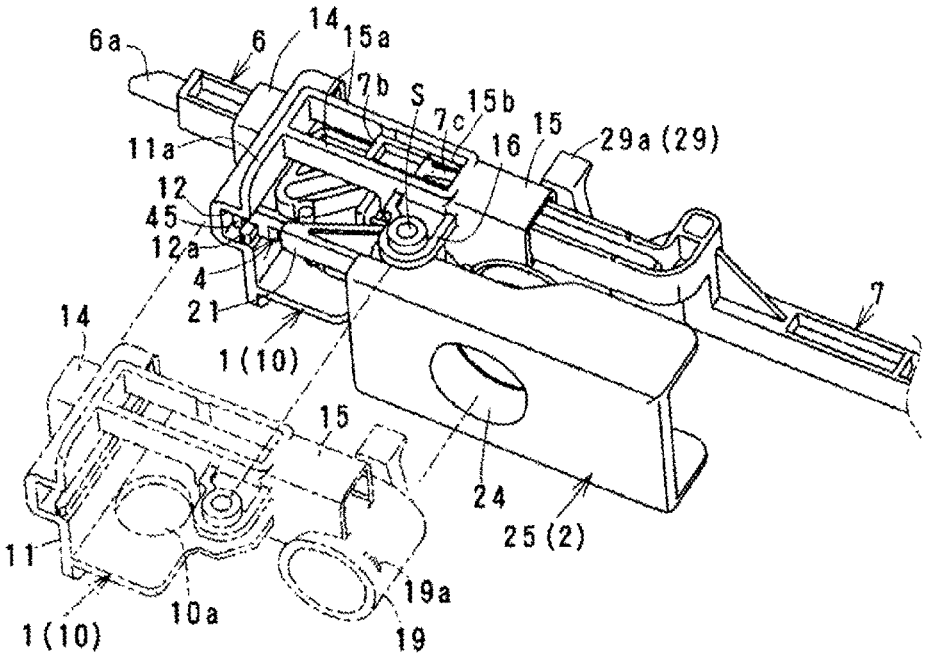
FIGS. 1(*a*) and 1(*b*) show external views of a locking device according to an embodiment of the present invention, wherein FIG. 1(*a*) is a perspective view seen from a front face side.
Figure 1B:
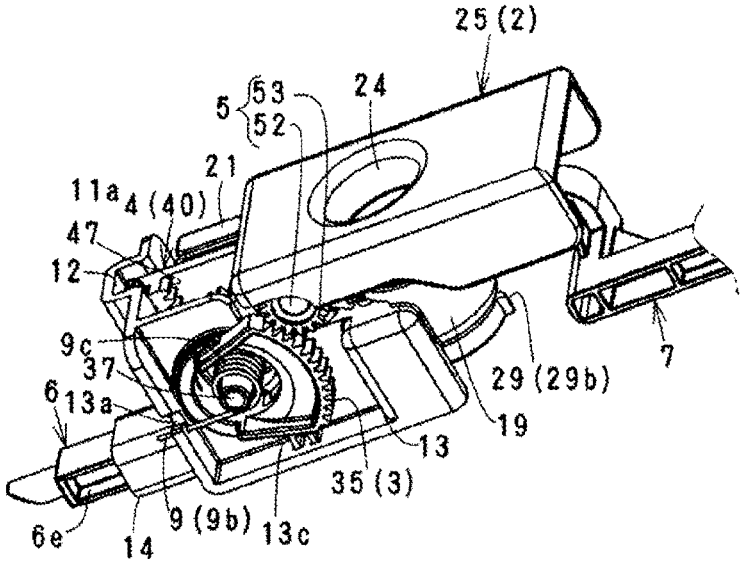
Figure 9A:
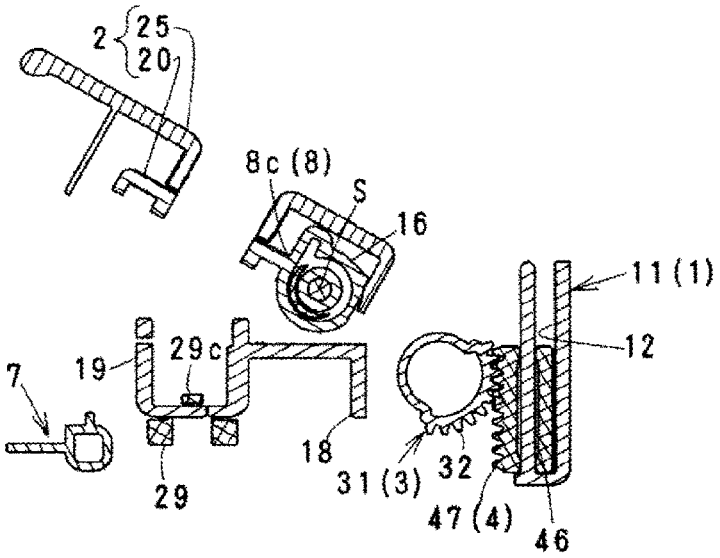
FIGS. 9(*a*) to 9(*c*) show the operation of the aforementioned locking device, wherein FIG. 9(*a*) is a cross-sectional view taken along a line B1-B1 in FIG. 8(*b*)
Figure 9B:
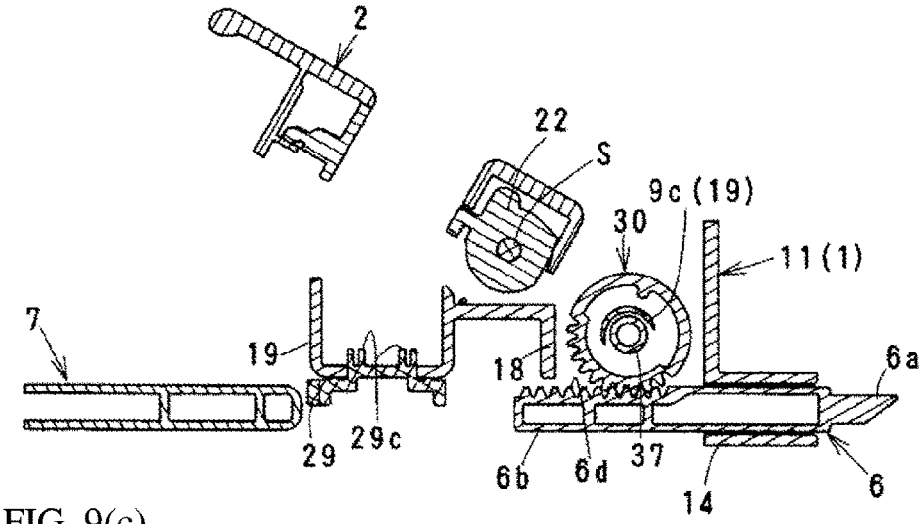
Figure 9C:
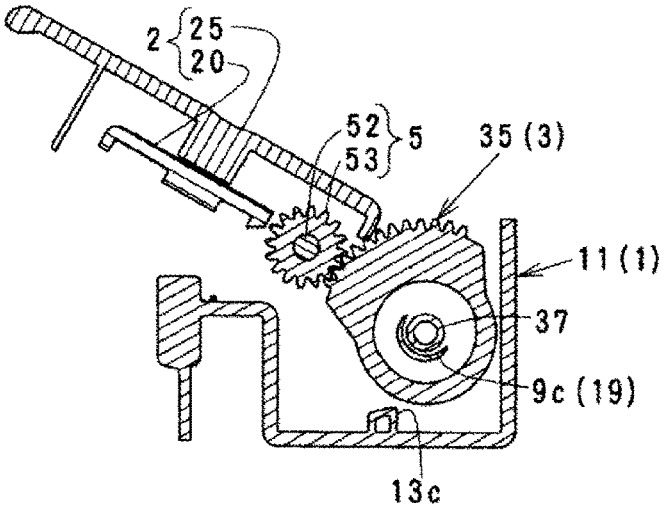
Figure 10A:
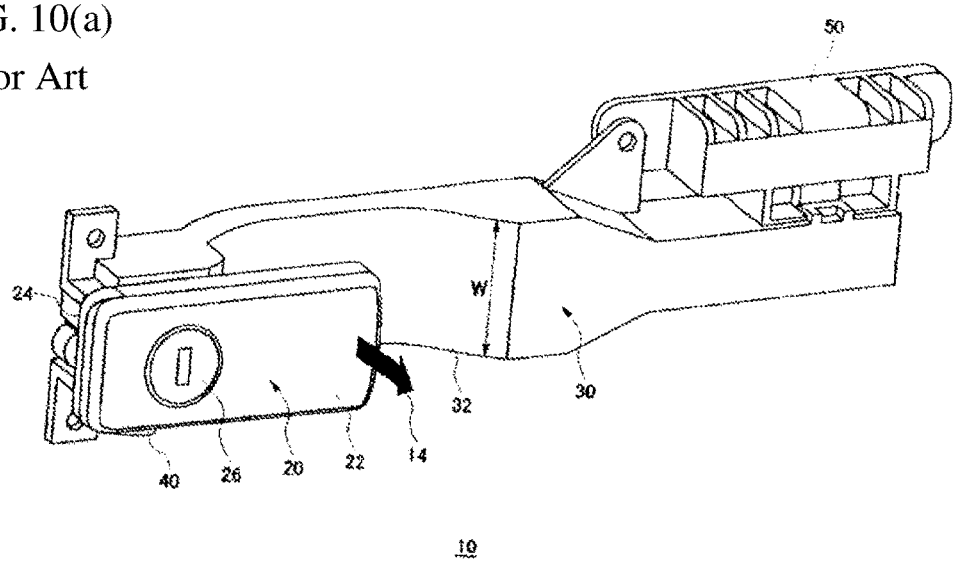
FIG. 10(a) Prior Art
FIGS. 10(*a*) and 10(*b*) are explanatory views showing a locking device of Patent Document 1.
Figure 10B:
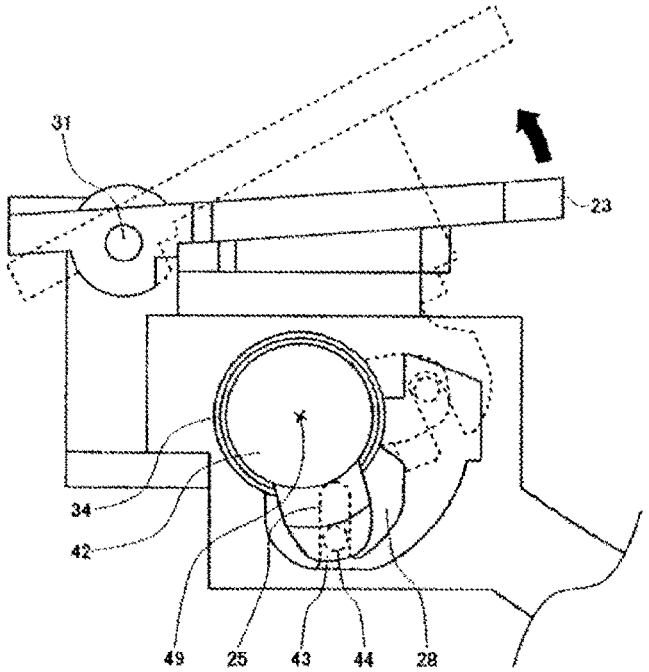
FIG. 10(b) Prior Art

(Structural Example) As shown in FIG. 1(*a*) to FIG. 9(*c*) as an example, the subject locking device comprises a base 1 attached to a lid member (not shown in the figures); a lever 2 turnably provided in the base 1, and switched from an initial state to an operating state against an urging force (technically, it may be self-weight); lock rods 6 and 7 sliding in association with the turning of the lever 2; and a rotation damper 5 as a braking device. The locking device is a type of locking the lid member on a main member side through the lock rods 6 and 7, and switching to unlock by the turning of the lever 2.

Here, regarding the base 1, the base 1 may be provided integrally with the adopted lid member so as to be omitted from essential components of the locking device according to the present invention. Also, regarding the lock rods 6 and 7, one lock rod can be omitted to form a single lock rod, so that in the essential components of the locking device according to the present invention, the lock rods 6 and 7 are simply specified as the lock rod.

Figure 4A:
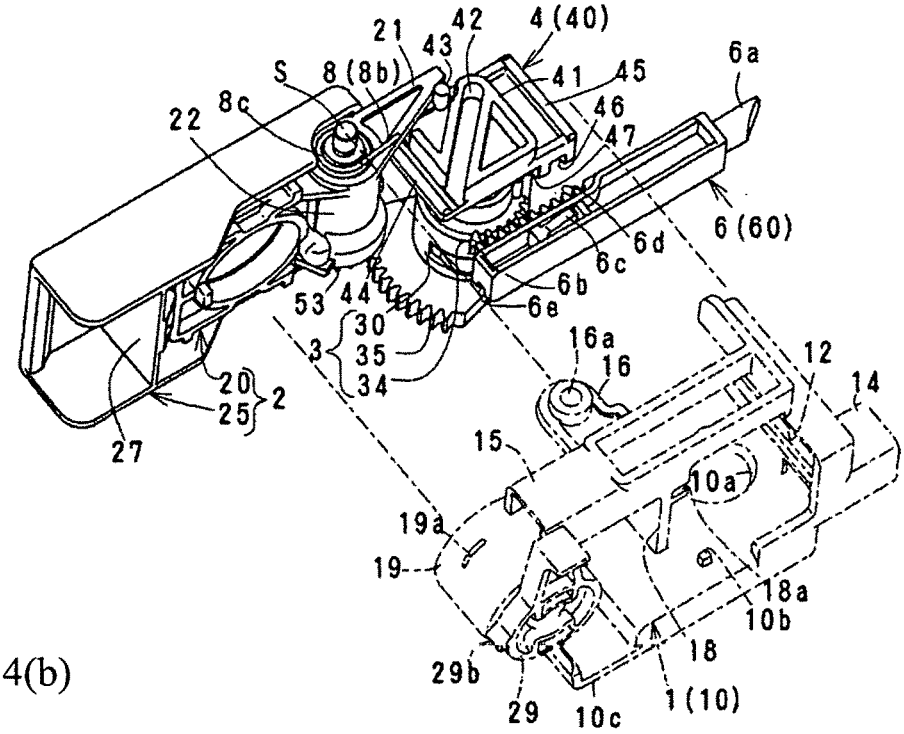
FIGS. 4(*a*) and 4(*b*) show an operation of one lock rod of the aforementioned locking device, wherein FIG. 4(*a*) is a perspective view in an initial state of a lever.
Figure 4B:
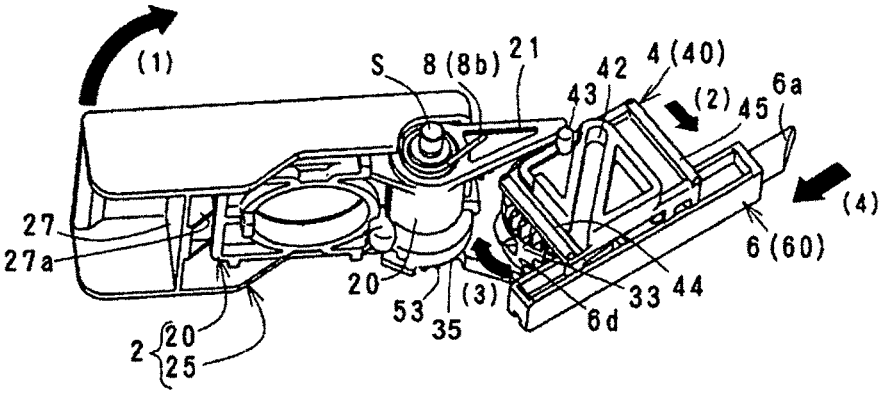
Figure 5A:
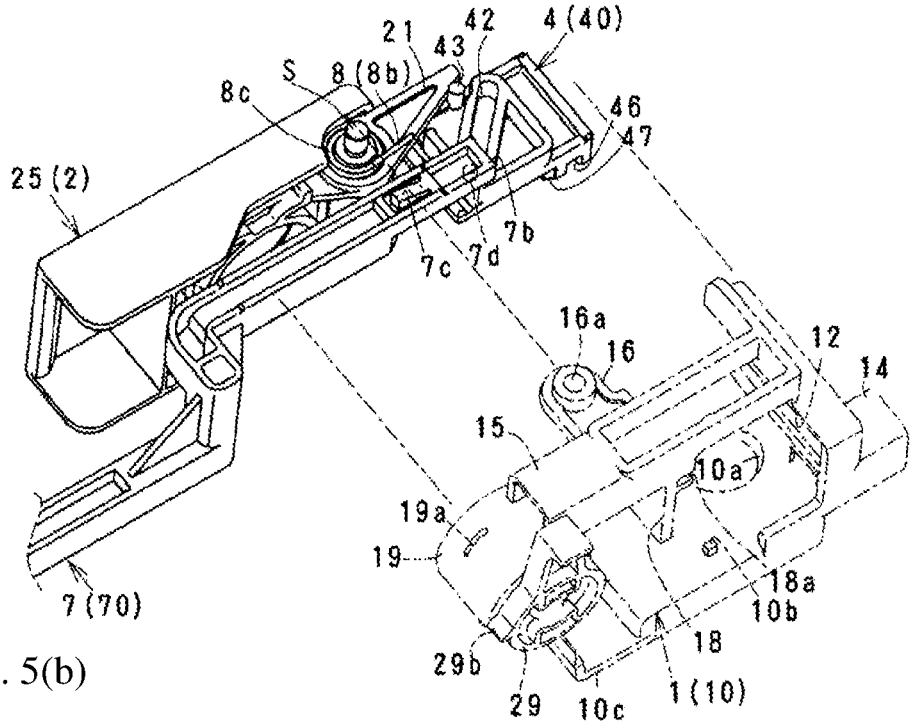
FIGS. 5(*a*) and 5(*b*) show the operation of the other lock rod of the aforementioned locking device, wherein FIG. 5(*a*) is a perspective view in the initial state of the lever.
Figure 5B:
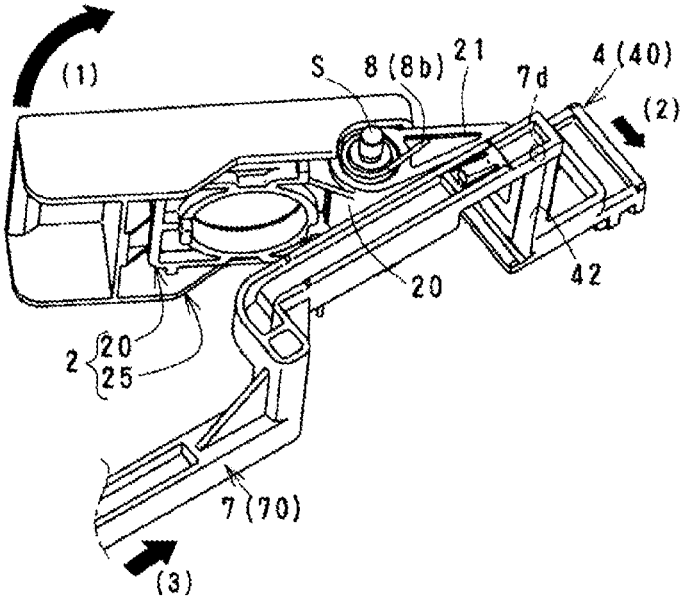
Figure 7A:
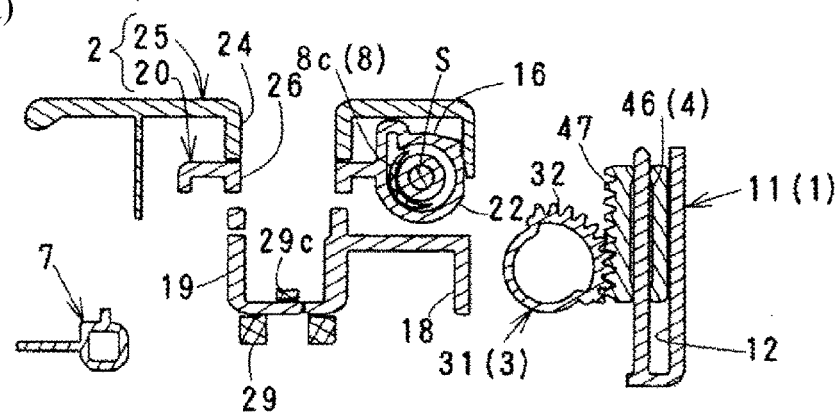
FIGS. 7(*a*) to 7(*c*) show the operation of the aforementioned locking device, wherein FIG. 7(*a*) is a cross-sectional view taken along a line B-B in FIG. 6(*b*)
Figure 7B:
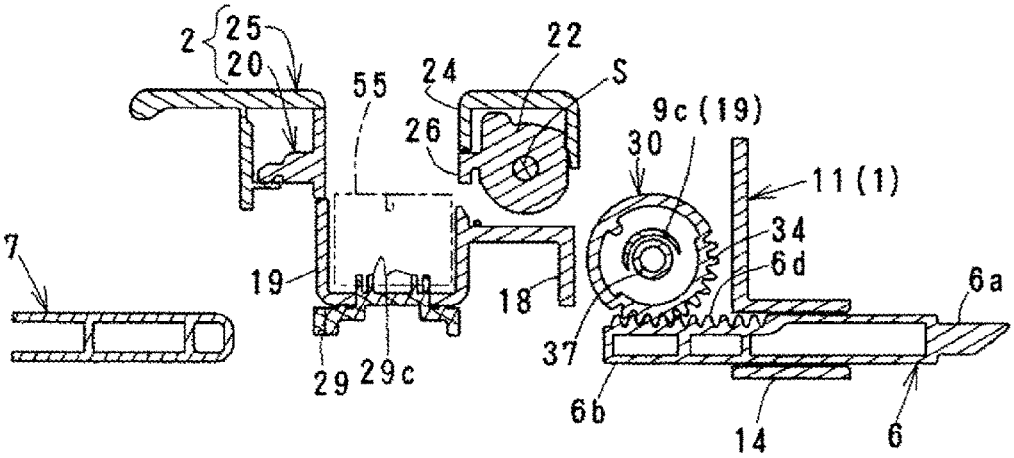
Figure 7C:
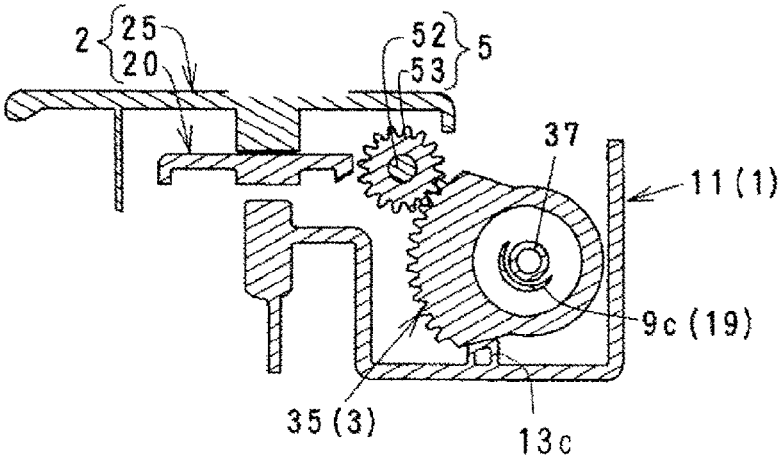

Namely, as for a device structure, the following structures can be selected: as shown in FIG. 1(*a*) to FIG. 4(*b*), and FIG. 7(*a*) to FIG. 9(*c*), a structure which can switch between a locking position wherein a pair of lock rods 6 and 7 is separated from each other to keep the lid member in a closed state, and a release position wherein the pair of lock rods 6 and 7 approaches each other to release the aforementioned locking; and a structure which can switch the locking position wherein the lock rod 7 in the lock rods 6 and 7 is omitted as shown in FIGS. 4(*a*) and 4(*b*), or the lock rod 6 is omitted as shown in FIGS. 5(*a*) and 5(*b*). Basically, the single lock rod protrudes to keep the lid member in the closed state, and the release position wherein the single lock rod retracts to an original position to release the aforementioned locking.

Main essential portions are that: there are included the lever 2 turnably pivoted on the base 1 or the lid member, and a slide member 4 sliding in association with the turning of the lever 2; there is included a braking shaft 52 with a gear 53 as the rotation damper 5, and the braking shaft 52 is placed so as to approximately conform to the turning center of the lever relative to the lever 2, and damp the lever 2 and the lock rod 6 or 7; and there is included an operation gear 3 disposed in a state engaged with the gear 53 of the rotation damper, associating the gear 53 with sliding of the lock rods 6 and 7, and rotating the gear 53 in a direction opposite to the turning of the lever 2. Next, details of the aforementioned portions will be clarified.

Figure 2A:
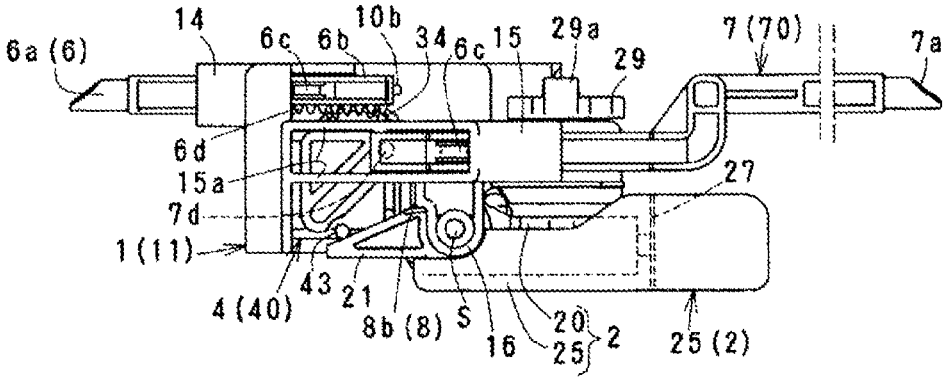
FIGS. 2(*a*) to 2(*c*) show details of the aforementioned locking device, wherein FIG. 2(*a*) is a top view.
Figure 2B:
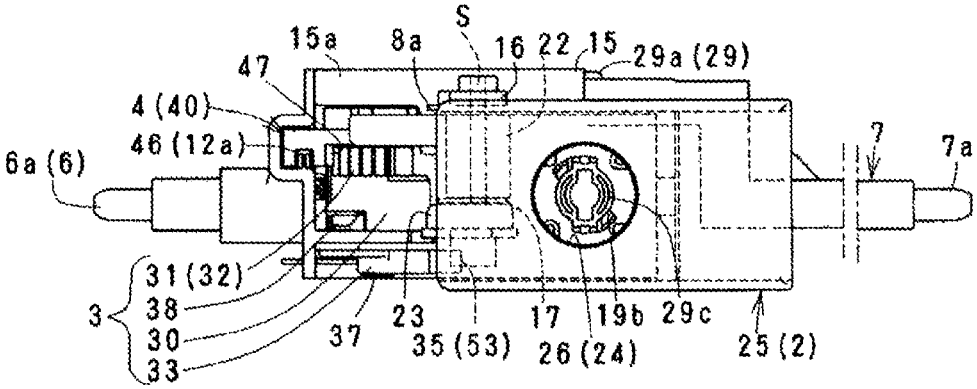
Figure 2C:
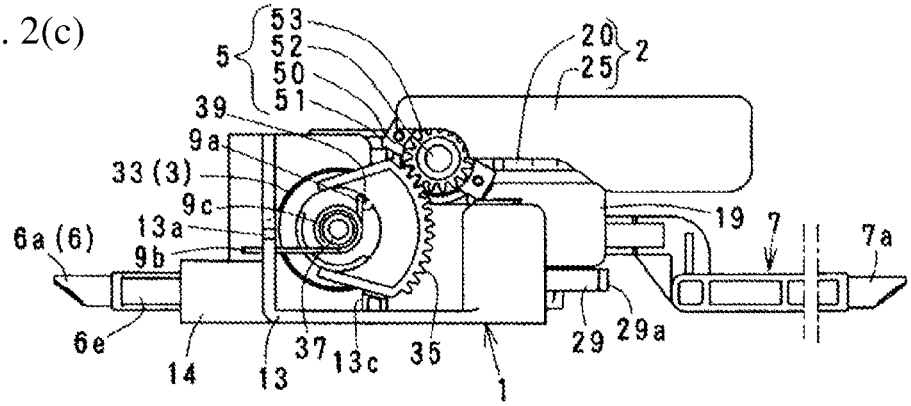

First, as shown in FIGS. 1(*a*) and 1(*b*), FIGS. 5(*a*) and 5(*b*), and the like, the base 1 integrally includes a support plate 10 provided in a horizontal state, and retaining the operation gear 3 and the like; a side plate 11 provided on one side of the support plate 10; a lower frame portion 13 provided on a lower side of the support plate 10; guide portions 14 and 15 slidingly housing and retaining backward portions of the lock rods 6 and 7; upper and lower pivot pieces 16 and 17 (see FIG. 2(*b*)) pivoting the lever 2; a vertical plate 18 slidingly supporting the slide member 4 between the vertical plate 18 and the side plate 11; and a placement cylindrical portion 19 for a lock or a cylinder provided on a side opposite to the side plate 11. Incidentally, in FIGS. 1(*a*) and 1(*b*), FIGS. 4(*a*) and 4(*b*), and FIGS. 5(*a*) and 5(*b*), the base 1 is shown with imaginary lines as well for the sake of explanation.

The support plate 10 forms a circular hole portion 10*a*, and a convex portion 10*b* (see FIG. 4(*a*)) at a back of the hole portion 10*a*, and the operation gear 3 is inserted relative to the hole portion 10*a* to be placed in a state wherein an upper side portion thereof higher than a lower frame portion 13 side is retained. The convex portion 10*b* can guide the lock rod 6 as described later. In the side plate 11, there is provided a horizontal groove 12 having a C-shaped cross section, and there is provided a rail 12*a* having a convex-shaped cross section along a groove bottom face of the horizontal groove 12 (see FIG. 1(*a*)).

In the lower frame portion 13, there are provided a locking groove 13*a* for a spring member 9 directly below the side plate 11; and a control projection 13*c* controlling a rotation angle of the operation gear 3 as shown in FIG. 7(*c*). The guide portion 14 has an approximately rectangular cylindrical shape, protruding sideways more than a lower side of the side plate 11, and allows a back side of the lock rod 6 to slide along the support plate 10 from an opening penetrating the side plate 11. The guide portion 15 has an approximately rectangular cylindrical shape, is provided on the placement cylindrical portion 19, and includes an extension portion 15*a* penetrating up and down between the extension portion 15*a* and an upper portion 11*a* of the side plate, and divided by both side plates.

Figure 6A:
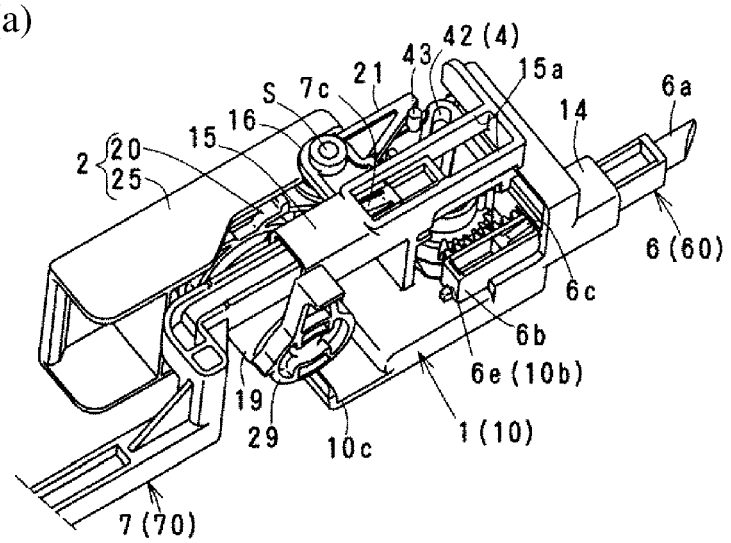
FIGS. 6(*a*) to 6(*c*) show the operation of the aforementioned locking device, wherein FIG. 6(*a*) is a perspective view in the initial state of the lever.
Figure 6B:
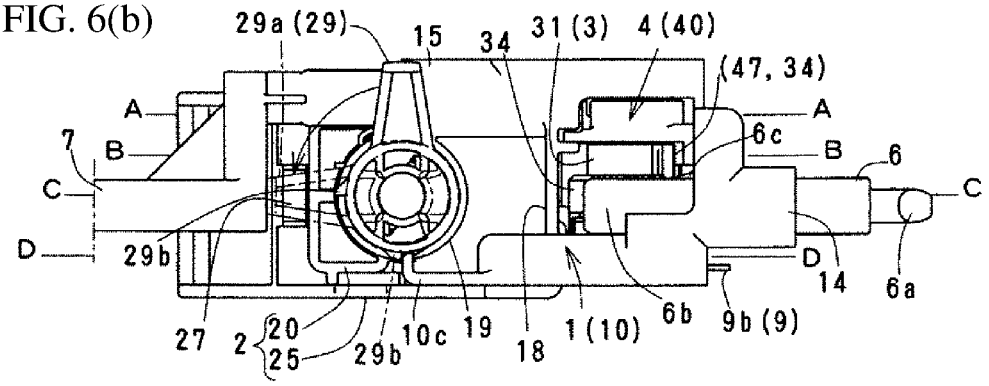
Figure 6C:
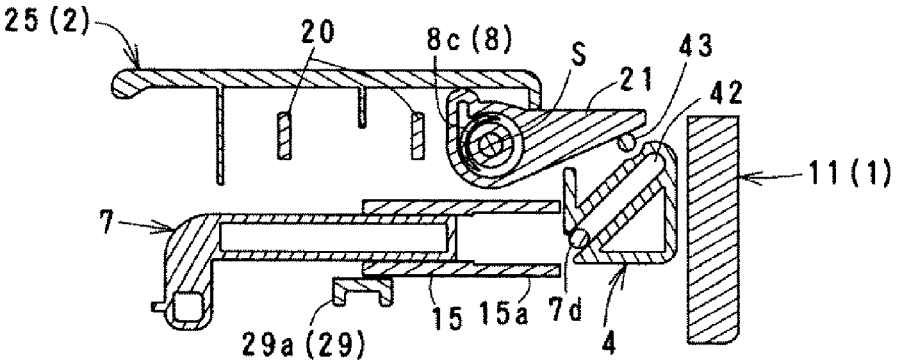

As shown in FIG. 2(*b*), the upper and lower pivot pieces 16 and 17 protrude approximately in parallel at a front side (a side where the lever 2 is disposed) of the guide portion 15 and the extension portion 15*a*, and include shaft holes provided on the same shaft line to insert a shaft S to pass through. As shown in FIG. 5(*a*), in the vertical plate 18, there is provided a horizontal groove 18*a* facing the horizontal groove 12. The horizontal groove 18*a* is narrower than a groove width of the horizontal groove 12. As shown in FIGS. 6(*a*) and 6(*b*), in the placement cylindrical portion 19, there is provided a cylinder lock 29 turnably only for a predetermined angle at a back end side.

Namely, as shown in FIGS. 6(*a*) and 6(*b*), and FIGS. 7(*a*) and 7(*b*), the cylinder lock 29 includes an abutment portion 29*a* (see FIG. 6(*c*)) protruding from a periphery of a main member having an approximately circular plate shape placed on an outer end face of the placement cylindrical portion 19, and bending a tip thereof; a control claw 29*b* (see FIG. 4(*a*)) provided in the periphery of the main member, and controlling a turning range; and a retaining portion 29*c* (see FIGS. 7(*a*) and 7(*b*)) inserted into a cylindrical portion to be capable of being retained from an attachment hole provided on the outer end face of the placement cylindrical portion 19.

Then, in the cylinder lock 29, when the control claw 29*b* is turned for approximately 90 degrees until the control claw 29*b* abuts against a stopper plate portion 10*c* extending to a placement cylindrical portion 19 side from the support plate 10 as shown by imaginary lines in FIG. 6(*b*) by a key operation of a lock or a cylinder 55 (see FIG. 7(*b*)) disposed in the placement cylindrical portion 19, the abutment portion 29*a* can abut against a corresponding portion of the lock rod 7, thereby projecting each lock rod 6, 7 to keep in a lock state locked in engagement holes on the main member side.

Incidentally, in the placement cylindrical portion 19, as shown in FIG. 1(*a*), there are provided a locking hole 19*a* used when the cylinder 55 is placed, and the like. Also, in the aforementioned cylinder rod 29, for example, if it is formed by only the lock rod 6 in FIGS. 4(*a*) and 4(*b*) of both lock rods, the cylinder lock 29 is turned to a side opposite to the aforementioned side, and the abutment portion 29*a* can abut against a corresponding portion of the lock rod 6, thereby keeping the lock rod 6 in the lock state.

Next, the lever 2 will be described in detail. As shown in FIGS. 2(*a*) to 2(*c*), FIGS. 4(*a*) and 4(*b*), and the like, the lever 2 is formed by a main member 20 which is a core material; and a cover 25 covering a front face side of the main member 20, and forming a design surface. The main member 20 includes a pressing piece 21 pushing the slide member 4; a connection portion 22 having a bottomed cylindrical shape pivoting on the upper and lower pivot pieces 16 and 17 through the shaft S; a claw portion 22*b* provided in a periphery of the connection portion 22; an attachment portion 23 forming an inverted concave portion disposing the rotation damper 5; and a through-hole 24 communicated with the placement cylindrical portion 19. Incidentally, in a cylinder bottom portion of the connection portion 22, there is provided a hole for a shaft.

Figure 3A:
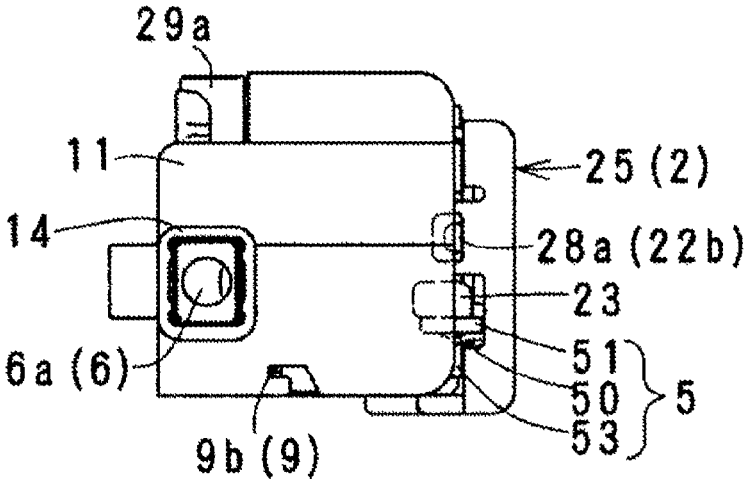
FIGS. 3(*a*) and 3(*b*) show the locking device shown in FIGS. 2(*a*) to 2(*c*), wherein FIG. 3(*a*) is a left side view.
Figure 3B:
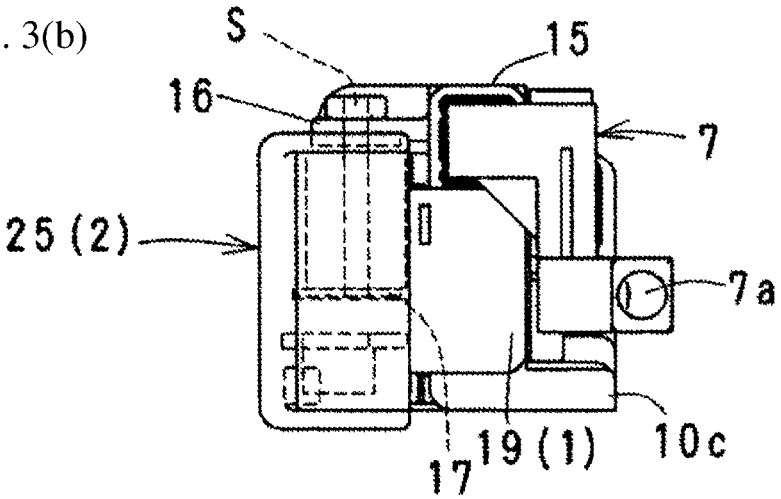

The cover 25 includes a through-hole 26 provided in an approximately center portion, and superimposed on the through-hole 24; as shown in FIG. 2(*a*) and FIG. 3(*a*), a partition wall 27 provided on an inner face side; a projection 27*a* provided on the partition wall 27; a side portion 28 on one end side; and an engagement hole 28*a* provided on the side portion 28. Then, the cover 25 is disposed relative to the main member 20 such that the main member 20 is sandwiched between the partition-wall-side projection 27*a* and the side portion 28, and placed in a state wherein the engagement hole 28*a* is engaged with the claw portion 22*b*.

Also, in the lever 2 integrated as mentioned above, the rotation damper 5 is attached to the attachment portion 23 on the main member side. The rotation damper 5 is formed by a well-known rotary-type oil damper and the like, and includes a main member 50 with attachment portions 51; the braking shaft 52 which is an output shaft receiving a resistance of an operating oil inside the main member 50; and the gear 53 placed in the braking shaft. Then, in the rotation damper 5, the main member 50 is disposed in the inverted concave portion of the attachment portion 23 relative to the attachment portion 23, and each attachment portion 51 is fixed by a screw and the like.

The lever 2 is turnably assembled relative to the base 1 in a state wherein the rotation damper 5 is placed through the shaft S and an urging member 8. Namely, in the lever 2, after the urging member 8 is disposed inside a cylinder of the connection portion 22, in a state wherein the connection portion 22 is disposed between the upper pivot piece 16 and the lower pivot piece 17 of the base, the shaft S penetrates the later-described winding portion 8*c* from the hole of the upper pivot piece 16, and furthermore, the shaft S is inserted into the hole of the lower pivot piece 17 so as to turnably assemble the lever 2 to the base 1. In the urging member 8, one end (not shown in the figures) is locked inside the cylinder of the connection portion 22; the middle winding portion 8*c* is disposed inside the cylinder of the connection portion 22; and the other end 8*b* is locked in an upper pivot piece 16 side. Thereby, the lever 2 is turned in a direction of approaching a base 1 side by an urging force of the urging member 8 to be kept in the initial state. Also, the lever 2 is turned in a direction of separating from the base 1 against the urging force to be switched to the operating state.

However, the aforementioned assembly is carried out after the later-described operation gear 3 and slide member 4 are disposed relative to the base 1. The operation gear 3 can be disposed even after the lever 2 is assembled to the base 1.

As shown in FIGS. 2(*b*) and 2(*c*), and FIGS. 4(*a*) and 4(*b*), the operation gear 3 comprises a cylindrical trunk portion 30 inserted into the hole portion 10*a* of the support plate; an upper portion 31 integrated with an upper end of the trunk portion 30, and forming a teeth portion 32 around a head having a diameter slightly smaller than that of the trunk portion; a lower flange portion 33 provided on a lower periphery of the trunk portion; a shaft portion 37 having a small cylindrical shape protruded on an inner bottom face of the trunk portion; and a vertical rib 39 provided on an inner periphery face of the small cylindrical shape.

Also, the trunk portion 30 includes a teeth portion 34 provided on a side different from the teeth portion 32; and a locking piece 38 provided in the trunk portion 30 to be elastically swayable through a slit, and sandwiching the support plate 10 between the locking piece 38 and the lower flange portion 33. The lower flange portion 33 integrally includes a fan-shaped portion forming a teeth portion 35 on an outer periphery thereof.

In the aforementioned operation gear 3, the trunk portion 30 and the upper portion 31 are inserted into the hole portion 10*a* accompanied by a diameter reduction of the locking piece 38 relative to the support plate 10, and at the same time as the locking piece 38 passes through, the locking piece 38 returns to an original state so as to be retained and incorporated. Also, in the operation gear 3, an end face of the fan-shaped portion is turned in a clockwise direction until the end face of the fan-shaped portion abuts against the control projection 13*c* of the lower frame portion 13 by an urging force of the spring member 9 disposed inside a cylinder of the trunk portion 30. Also, in the operation gear 3, the aforementioned teeth portion 35 is engaged with the gear 53 of the rotation damper, so that the operation gear 3 is damped by the rotation damper 5 to be gently turned. Incidentally, in the spring member 9, one end 9*a* is locked in the vertical rib 39 inside the cylinder of the connection portion 22; a middle winding portion 9*c* is disposed in a state penetrated by a periphery of the shaft portion 37; and the other end 9*b* is locked in the locking groove 13*a* of the lower frame portion.

On the other hand, as shown in FIGS. 1(*a*) and 1(*b*), and FIGS. 4(*a*) and 4(*b*), the slide member 4 includes an approximately rectangular flat plate portion 40; an inclined groove 42 formed by a standing wall 41 protruded on the flat plate portion 40; a shaft portion 43 protruded in a front of the flat plate portion 40, i.e. on the side where the lever 2 is disposed, and in a position close to the inclined groove 42; one side portion 44 of the flat plate portion 40 slidingly fitted in the horizontal groove 18*a*; and the other side portion 45 of the flat plate portion 40 slidingly fitted in the horizontal groove 12.

The inclined groove 42 is inclined in a direction of separating from the side plate 11 from a position near the side plate 11 as extending toward a back from in a front side. The shaft portion 43 is protruded in such a way as to approximately conform to a face on the front side of the flat plate portion 40, and pushed by the pressing piece 21 by the turning of the lever 2 so as to allow the slide member 4 to slide. In both side portions 44 and 45, upper faces thereof are formed in an approximately semi-cylindrical shape so as to easily slide. Also, the side portion 45 has a lower face thickened for one step, and forms a fitting groove 46 having an inverted concave shape in a cross section slidingly fitting into the aforementioned rail 12*a*. Also, the side portion 45 forms a latch 47 engaging the teeth portion 32 on an inside face which is one-step thickened as mentioned above.

The aforementioned slide member 4 is incorporated into the base 1 in a state wherein both side portions 44 and 45 are fitted into the corresponding horizontal grooves 18*a* and 12. In that case, preferably, in a state wherein the slide member 4 is positioned relative to the base 1, the operation gear 3 is incorporated in the aforementioned manner.

As shown in FIGS. 2(*a*) to 2(*c*), and FIGS. 4(*a*) and 4(*b*), the lock rod 6 has a rectangular shape in a cross section wherein a main member 60 corresponds to the guide portion 14 on a base side, and protrudes a tip 6*a* having a round bar shape on one end face. In the main member 60, an upper face thereof is formed in a concave shape in a cross section, and the main member 60 includes a retaining claw 6*c* provided slightly in the front of a back end 6*b*. In the retaining claw 6*c*, one portion thereof protrudes from the upper face of the main member, and the retaining claw 6*c* elastically reduces a diameter thereof in a process of inserting the main member 60 into a cylinder of the guide portion 14, and at the same time as the retaining claw 6*c* passes through, the retaining claw 6*c* returns to an original state so as to prevent the lock rod 6 from being unexpectedly detached from the guide portion 14.

Also, in the main member 60, a lower face thereof is formed in an inverted concave portion 6*e* in a cross section as well, and when the main member 60 is inserted into the guide portion 14 to be moved onto the support plate 10, the main member 60 slidingly fits into the convex portion 10*b*. The main member 60 includes a rack 6*d* located on an inner side face and provided in the back end 6*b* further than an approximately middle in a length direction of the main member. The rack 6*d* engages the teeth portion 34 of the operation gear 3. Thereby, in the structure, the slide member 4 and the operation gear 3 are associated with the turning of the lever 2, and a movement of the lock rod 6 is associated as well.

As shown in FIGS. 2(*a*) to 2(*c*), and FIGS. 5(*a*) and 5(*b*), in the lock rod 7, a main member 70 is substantially longer than the main member 60, and is formed to bend in a middle in a longitudinal direction. Also, the lock rod 7 has a rectangular shape in a cross section corresponding to the guide portion 15 on the base side, and protrudes a tip 7*a* having a round bar shape on one end face. In the main member 70, an upper face on a back end 7*b* side is formed in a concave shape in a cross section, and the main member 70 includes a retaining claw 7*c* provided inside the concave shape. In the retaining claw 7*c*, one portion thereof protrudes from the upper face of the main member, and the retaining claw 7*c* elastically reduces a diameter thereof in a process of inserting a back side portion of the main member 70 into a cylinder of the guide portion 15, and at the same time as the retaining claw 7*c* passes through, the retaining claw 7*c* returns to an original state so as to prevent the lock rod 7 from being unexpectedly detached from the guide portion 15.

Also, the main member 70 includes a shaft portion 7*d* protruded on a lower face of the back end 7*b*. The shaft portion 7*d* slidingly fits into the inclined groove 42 on a slide member side. Consequently, in the structure, when the slide member 4 slides backward by the pressing piece 21 by the turning of the lever 2, the lock rod 7 moves in association with the aforementioned sliding in a retraction direction wherein the lock rod 7 reduces a projecting amount by a position of the inclined groove 42 relative to the shaft portion 7*d*.

(Operation) Hereinafter, main operation characteristics of the locking device formed as mentioned above will be described.

(1) FIGS. 4(*a*) and 4(*b*) are a structural example corresponding to the lock and unlock states with the single lock rod 6. FIG. 4(*a*) shows the locking position of the lock rod 6, i.e. the lock state wherein the tip 6*a* is engaged with the engagement hole provided on the main member side. The lock state thereof is the initial state wherein the lever 2 is approximately in parallel to the base 1 in a state of abutting the pressing piece 21 against a just-in-front-side end face of the flat plate portion 40 and the shaft portion 43. In the initial state, as shown in FIG. 2(*b*), the operation gear 3 is operated to be connected to the slide member 4 by an engagement between the teeth portion 32 and the rack 47, and operated to be connected to the rotation damper 5 by an engagement between the teeth portion 35 and the gear 53. Simultaneously, the lock rod 6 is operated to be connected to the operation gear 3 by an engagement between the rack 6*d* and the teeth portion 34 to protrude to the maximum, i.e. move to a lock position.

(2) FIG. 4(*b*) shows the operating state wherein the lever 2 is turned in a direction of an arrow 1 against the urging force of the urging member 8 as a supporting point of the shaft S, i.e. an unlock direction separating from the base 1. In the operating state, the pressing piece 21 on a lever side slides the slide member 4 in a direction of an arrow 2, and in association with that, as shown in FIG. 4(*b*), the operation gear 3 turns in a clockwise direction of an arrow 3 by the engagement between the teeth portion 32 and the rack 47. In the turning of the operation gear 3, urging forces are accumulated in the spring member 9, and the operation gear 3 receives a braking force of the rotation damper 5 by the engagement between the teeth portion 53 and the gear 53 so as to gently turn. Then, the lock rod 6 moves in a retraction direction of an arrow 4, i.e. the unlock direction in association with the turning of the operation gear 3 by the engagement between the teeth portion 34 and the rack 6*d*.

(3) When the pressing relative to the lever 2 is released from the operating state in FIG. 4(*b*), i.e. one's hand is released from the lever 2, the lever 2 is turned in a direction opposite to the arrow 1, i.e. a direction of the initial state by the urging force of the urging member 8 as the supporting point of the shaft S. Then, the operation gear 3 is turned in a counterclockwise direction, which is a direction opposite to the arrow 3, by the engagement between the gear 53 of the rotation damper 5 and the teeth portion 35. In the turning of the operation gear 3, the slide member 4 slides in a direction opposite to the arrow 2 by the engagement between the teeth portion 32 and the rack 47, and at the same time, the lock rod 6 moves in a direction opposite to the arrow 4, i.e. a lock direction by the engagement between the teeth portion 34 and the rack 6*d*. At that time, the operation gear 3 receives the braking force of the rotation damper 5 by the engagement between the teeth portion 35 and the gear 53 to gently turn, so that the lever 2, the lock rod 6, and the slide member 4 forming a lock mechanism gently move as well to switch from the operating state to the initial state. As a result, a hitting sound of the returning lever 2, and hitting sounds generated accompanied by a sliding halt of the slide member 4 or the lock rod 6 can be absorbed to be reduced so as to improve usability or provide a high-quality feeling.

(4) FIGS. 5(*a*) and 5(*b*) show lock and unlock states with the single lock rod 7. Namely, FIG. 5(*a*) shows the locking position of the lock rod 7, i.e. the lock state wherein the tip 7*a* (not shown in the figures) is engaged with the engagement hole provided on the main member side. The lock state thereof is the initial state wherein the lever 2 is approximately in parallel to the base 1 with the state of abutting the pressing piece 21 against the just-in-front-side end face of the flat plate portion 40 and the shaft portion 43 of the slide member 4, and the lock rod 7 protrudes to the maximum, i.e. located in the lock position. FIG. 5(*b*) shows the operating state wherein the lever 2 is turned in the direction of the arrow 1 against the urging force of the urging member 8 as the supporting point of the shaft S, i.e. the unlock direction separating from the base 1. In the operating state, the pressing piece 21 on the lever side pushes the slide member 4, and when the slide member 4 slides backward by the pressing piece 21, as mentioned above, the lock rod 7 moves in association with the aforementioned sliding in the retraction direction of the arrow 3, i.e. the unlock direction by the position of the inclined groove 42 relative to the shaft portion 7*d*.

Also, when the pressing relative to the lever 2 from the operating state in FIG. 5(*b*) is released, i.e. one's hand is released from the lever 2, the lever 2 is turned in the direction opposite to the arrow 1, i.e. the direction of the initial state by the urging force of the urging member 8 as the supporting point of the shaft S. Then, in this structure, the operation gear 3 turns in the clockwise direction by the engagement between the gear 53 and the teeth portion 35, and the urging force of the spring member 9. At the same time, the slide member 4 slides in the direction opposite to the arrow 2 by the engagement between the teeth portion 32 and the rack 47. In association with the aforementioned sliding of the slide member 4, the lock rod 7 moves in the direction opposite to the arrow 3, i.e. the lock direction by the position of the inclined groove 42 relative to the shaft portion 7*d*. As a result, even in this case, the gear 53 of the rotation damper 5 is engaged with the teeth portion 35 of the operation gear 3, so that the hitting sound of the returning lever 2, and a hitting sound generated accompanied by a sliding halt of the slide member 4 or the lock rod 7 can be absorbed to be reduced so as to improve the usability or provide the high-quality feeling.

(5) FIGS. 6(*a*) to 9(*c*) show an operation when both lock rods 6 and 7 are switched between the locking position wherein both lock rods 6 and 7 are separated from each other to keep the lid member in the closed state, and the release position wherein both lock rods 6 and 7 approach each other. This operation is the same as that in the case wherein the aforementioned structures in FIGS. 4(*a*) and 4(*b*), and FIGS. 5(*a*) and 5(*b*) are combined.

(6) Namely, FIGS. 6(*a*) to 6(*c*), and FIGS. 7(*a*) to 7(*c*) show the locking position of the lock rods 6 and 7, i.e. the lock state wherein the tips 6*a* and 7*a* are engaged with the two engagement holes provided on the main member side. The lock state thereof is the initial state wherein the lever 2 is approximately in parallel to the base 1 in the state of abutting the pressing piece 21 against the just-in-front-side end face of the flat plate portion 40 and the shaft portion 43 of the slide member 4. In the initial state, as shown in FIG. 7(*a*), the operation gear 3 is operated to be connected to the slide member 4 by the engagement between the teeth portion 32 and the rack 47, and as shown in FIG. 7(*c*), operated to be connected to the rotation damper 5 by the engagement between the teeth portion 35 and the gear 53. Simultaneously, as shown in FIG. 7(*b*), the lock rod 6 is operated to be connected to the operation gear 3 by the engagement between the rack 6*d* and the teeth portion 34 to be protruded to the maximum, i.e. moved to the lock position. On the other hand, as shown in FIG. 6(*c*), the lock rod 7 is protruded to the maximum, i.e. moved to the lock position by the position of the inclined groove 42 relative to the shaft portion 7*d*.

Figure 8A:
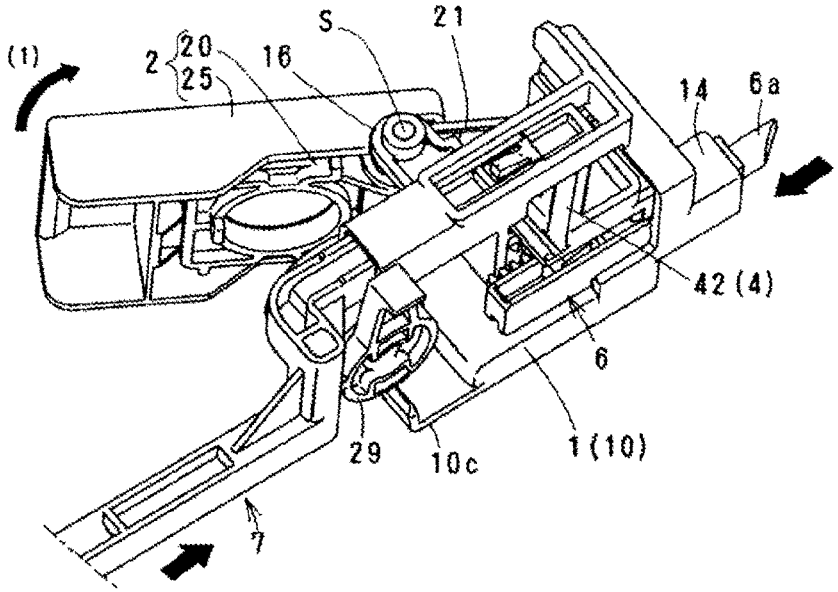
FIGS. 8(*a*) to 8(*c*) show the operation of the aforementioned locking device, wherein FIG. 8(*a*) is a perspective view in the operating state of the lever.
Figure 8B:
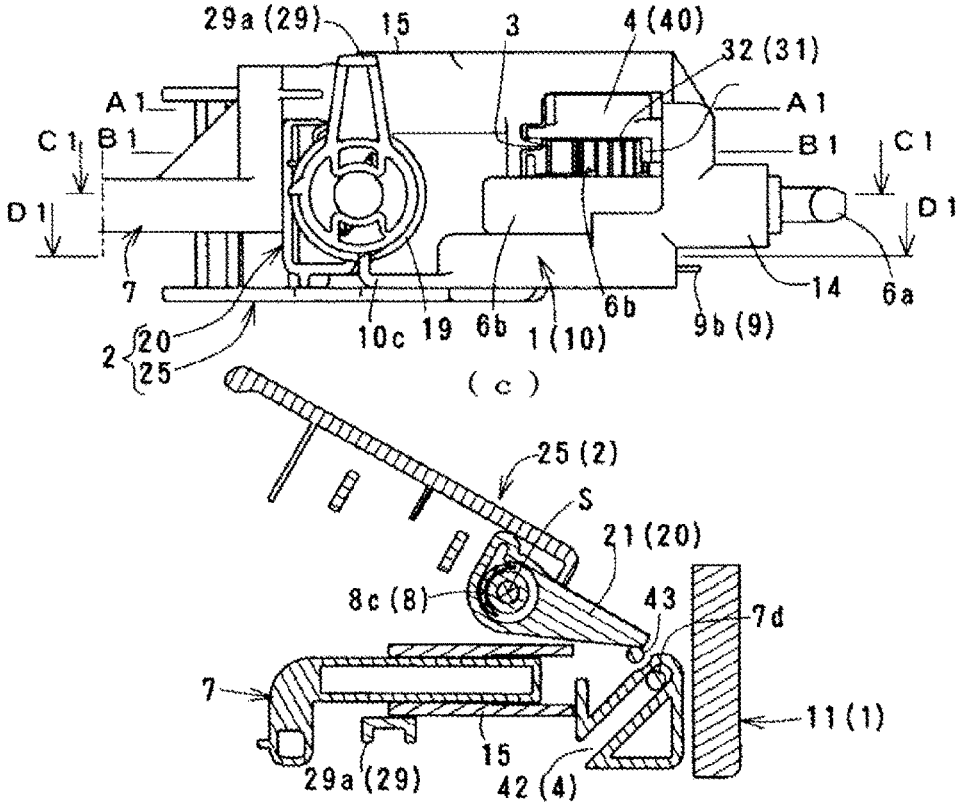

(7) FIGS. 8(*a*) to 8(*c*), and FIGS. 9(*a*) to 9(*c*) show the operating state wherein the lever 2 is turned in the direction of the arrow 1 in FIG. 8(*a*), i.e. the unlock direction separating from the base 1 against the urging force of the urging member 8 as the supporting point of the shaft S. In the operating state, the pressing piece 21 on the lever side slides the slide member 4 in a back direction, and in association with that, as shown in FIG. 9(*a*), the operation gear 3 turns in the clockwise direction by the engagement between the teeth portion 32 and the rack 47. In the turning of the operation gear 3, the urging forces are accumulated in the spring member 9, and the operation gear 3 receives the braking force of the rotation damper 5 by the engagement between the teeth portion 35 and the gear 53 so as to gently turn. Then, in association with the turning of the operation gear 3, the lock rod 6 moves in the retraction direction from the lock position, i.e. the unlock direction by the engagement between the teeth portion 34 and the rack 6*d*. On the other hand, in association with the aforementioned sliding in the back direction of the slide member 4, the lock rod 7 moves in the retraction direction from the lock position, i.e. the unlock direction by the position of the inclined groove 42 relative to the shaft portion 7*d*.

(8) When the pressing relative to the lever 2 is released from the operating state in FIGS. 8(*a*) to 8(*c*) and FIGS. 9(*a*) to 9(*c*), i.e. one's hand is released from the lever 2, the lever 2 is turned in the direction of the initial state by the urging force of the urging member 8 as the supporting point of the shaft S. Then, the operation gear 3 is turned in the clockwise direction by the engagement between the gear 53 of the rotation damper 5 and the teeth portion 35. In the turning of the operation gear 3, the slide member 4 slides forward by the engagement between the teeth portion 32 and the rack 47, and at the same time, the lock rod 6 protrudes again, i.e. moves in the lock direction by the engagement between the teeth portion 34 and the rack 6*d*. On the other hand, in association with the aforementioned forward sliding of the slide member 4, the lock rod 7 protrudes again, i.e. moves in the lock direction by the position of the inclined groove 42 relative to the shaft portion 7*d*. At that time, the operation gear 3 receives the braking force of the rotation damper 5 by the engagement between the teeth portion 35 and the gear 53 so as to gently turn, so that the lever 2, the lock rods 6 and 7, and the slide member 4 forming the lock mechanism gently move as well so as to be switched from the operating state to the initial state. As a result, the hitting sound of the returning lever 2, and the hitting sounds generated accompanied by the sliding halt of the slide member 4 or the lock rods 6 and 7 can be absorbed to be reduced so as to improve the usability or provide the high-quality feeling even in the case of the structure of the pair of lock rods 6 and 7.

Incidentally, in the locking device of the present invention, the details can be modified or expanded by reference to the aforementioned explanation provided that they comprise the structures specified in the main claims. As for one example, in the aforementioned embodiment, it is assumed that each member such as the lever or the like is assembled to the dedicated base 1 to fix the base 1 to a lid member side (not shown in the figures); however, a portion corresponding to the base 1 can be integrally formed in the lid member. Also, the aforementioned embodiment has the structure including the pair of lock rods 6 and 7; however, referring to FIGS. 4(*a*) and 4(*b*), or FIGS. 5(*a*) and 5(*b*), the embodiment can be formed by any one of the lock rods. The present invention includes the above-mentioned structures as well.

Incidentally, all contents of the specification, claims, drawings, and abstract of Japanese Patent Application No. 2013-215689 filed on Oct. 16, 2013 are cited in their entireties herein and are incorporated as a disclosure of the specification of the present invention.

What is claimed is:

1. A locking device, comprising:

a base adapted to be attached to a lid member;

a lever rotatably attached the base to be switched from an initial state to an operating state against an urging force or self-weight, and including a main member, the main member having a pressing portion at one side thereof, a connection portion turnably connected to the base for opening and closing a lid member, and an attachment portion provided at the connection portion;

a lock rod disposed on the base and sliding in association with turning of the lever, the lock rod having a shaft protruding from one end portion of the lock rod and a tip at another end portion of the lock rod opposite to the one end portion;

a braking device, which is a rotation damper, disposed on and attached to the attachment portion to be substantially coaxial to the connection portion of the lever for damping a rotational speed of the lever and a moving speed of the lock rod, the braking device including a member having an attaching portion attached to the attachment portion, a braking shaft, which is an output shaft, for receiving a resistance of a fluid disposed inside the member, and a gear attached to the braking shaft;

an operation gear disposed on the base and rotating about a rotational axis thereof, the operation gear including a trunk portion extending in the rotational axis, a first teeth portion having a plurality of first teeth arranged along a circumference of the trunk portion, and a second teeth portion arranged on the trunk portion coaxially to the first teeth portion and separately from the first teeth portion in a rotational axis direction of the operation gear, the second teeth portion having a plurality of second teeth arranged along the circumference of the trunk portion and engaging the gear of the braking device to rotate the gear in a direction opposite to a turning direction of the lever, the second teeth portion having a diameter larger than that of the first teeth portion for increasing a number of rotation of the gear of the braking device to obtain a stable braking force; and a slide member disposed on the base and sliding upon the turning of the lever, the slide member having a shaft portion protruding in the rotational axis direction and contacting the pressing portion of the lever, a rack engaging the first teeth portion of the operation gear to turn the operation gear in association with the sliding of the slide member, and a groove slidably receiving the shaft of the lock rod so that when the lever is turned to push and move the slide member in a first direction, the shaft of the lock rod slides along the groove of the slide member to move the lock rod in a second direction crossing the first direction to switch the lid member to be unlocked, wherein the lid member is adapted to be locked in the main member through the lock rod, and when the lever is turned to move the slide member in the first direction, the shaft of the lock rod slides along the groove of the slide member to move the lock rod in the second direction for switching the lid member to be unlocked and the operation gear simultaneously rotates so that the braking device engaged to the operation gear damps the moving speed of the lock rod.

2. A locking device according to claim 1, further comprising another lock rod slidably disposed with the lock rod to associate with the operation gear, wherein both lock rods are switched between a locking position where the both lock rods are separated from each other to keep the lid member in a closed state, and a release position where the both lock rods approach to each other.

3. A locking device according to claim 2, wherein the operation gear further includes a lock rod teeth portion engaging a rack provided in the another lock rod.

4. A locking device according to claim 1, wherein the braking device damps the rotational speed of the lever and the moving speed of the lock rod when the lid member is switched from being unlocked to be locked in the main member.

5. A locking device according to claim 1, further comprising another lock rod moving in association with the turning of the lever, wherein the operation gear further comprises a third teeth portion arranged coaxially to the first teeth portion and the second teeth portion and separately from the first teeth portion and the second teeth portion in the rotational axis direction of the operation gear to engage the another lock rod, and when the lever is turned to push and move the slide member, the shaft of the lock rod slides along the groove of the slide member and the operation gear simultaneously rotates to move the another lock rod so that the lock rod and the another lock rod move toward each other to switch the lid member to be unlocked.

6. A locking device according to claim 5, wherein the slide member includes a plate portion having first and second sides opposite to each other in the rotational axis direction, the shaft portion and the groove are disposed on the first side, and the rack is disposed on the second side.

7. A locking device according to claim 1, further comprising a first spring disposed between the lever and the base to rotate the lever, and a second spring disposed between the trunk portion of the operation gear and the connection portion to urge the operation gear in one direction.

* * * * *